US005248466A

United States Patent [19]

Russell, III

[11] Patent Number: 5,248,466

[45] Date of Patent: Sep. 28, 1993

[54] METHOD FOR MAKING CAST STONE

[76] Inventor: William N. Russell, III, c/o W. N. Russell & Company, 34-60 Albertson Ave., Westmont, N.J. 08108

[21] Appl. No.: 829,756

[22] Filed: Jan. 31, 1992

[51] Int. Cl.[5] ..... B28B 1/08; B28B 3/00

[52] U.S. Cl. ..... 264/72; 264/333; 425/150

[58] Field of Search ..... 264/69-72, 264/333, 40.5, 40.1, 334, 336; 425/135, 150

[56] References Cited

U.S. PATENT DOCUMENTS

| | | | |
|---|---|---|---|
| 1,884,528 | 10/1932 | Benner et al. | 264/72 |
| 1,937,028 | 11/1933 | Lux et al. | 264/72 |
| 2,237,691 | 4/1941 | Straub | 264/72 |
| 2,298,074 | 10/1942 | Straub | 264/72 |
| 3,385,347 | 5/1968 | Miller . | |
| 3,443,626 | 5/1969 | Miller . | |
| 3,658,118 | 4/1972 | Abraham . | |
| 3,712,785 | 1/1973 | Hirt et al. . | |
| 3,824,060 | 7/1974 | Helmrich . | |
| 4,140,744 | 2/1979 | Karas et al. | 264/72 |
| 4,226,820 | 10/1980 | Bjorhaag | 264/72 |
| 4,238,177 | 12/1980 | Crile et al. | 264/71 X |
| 4,445,839 | 5/1984 | Crane . | |
| 4,456,574 | 6/1984 | Frey et al. | 264/72 X |
| 4,545,754 | 10/1985 | Scheidt et al. . | |
| 4,725,220 | 2/1988 | Percinel et al. | 264/72 X |
| 4,915,888 | 4/1990 | Sato . | |

FOREIGN PATENT DOCUMENTS

| | | | |
|---|---|---|---|
| 1176041 | 8/1964 | Fed. Rep. of Germany | 264/71 |
| 84/00513 | 2/1984 | PCT Int'l Appl. | 264/72 |
| 618286 | 8/1978 | U.S.S.R. | 264/72 |
| 1013281 | 4/1983 | U.S.S.R. | 264/71 |
| 1207772 | 1/1986 | U.S.S.R. | 264/71 |
| 2127343 | 4/1984 | United Kingdom | 264/71 |

OTHER PUBLICATIONS

"PVKL Machine" by International Molding Machine Co.

*Primary Examiner*—Karen Aftergut
*Attorney, Agent, or Firm*—Howson & Howson

[57] ABSTRACT

Cast stone for architectural use is made by subjecting a mixture of aggregate and Portland cement in a mold to repeated dropping against an anvil, and thereafter applying a vertical pressure to the contents of the mold while applying repeated mechanical blows to a table on which the mold is situated. The process makes it possible to produce a high quality cast stone in 3-4 minutes as compared with the 20 minutes required using prior processes.

17 Claims, 3 Drawing Sheets

METHOD FOR MAKING CAST STONE

BRIEF SUMMARY OF THE INVENTION

This invention relates generally to processes and apparatus for casting non-metallic articles. The invention relates particularly to improvements in the production of an architectural building material known as "cast stone", and more particularly to an improved method and apparatus whereby cast stone can be produced more quickly, efficiently and inexpensively than was possible in the past.

Cast stone is an artificial stone made by molding a mixture of portland cement and aggregates. It resembles natural cut building stone, and is widely used for window sills, parapet coping, and trim bands of brick buildings, and in many other architectural applications, both indoor and outdoor.

Cast stone is characterized by a high compressive strength and low water absorption. Among the important advantages of cast stone over natural cut stone is that cast stone can be molded in both simple and complex shapes, and in any desired size. It also has the advantage that, by the incorporation of coloring material and appropriate coarse aggregates, the molded product can be provided in any desired color. For example, cast stone can be made to resemble natural limestone in various shades including white and pink, brownstone, white or gray granite, sandstone, and black slate.

Conventional concrete blocks are machine produced by molding a semi-dry concrete mixture using a vibration-under-pressure process. Precast concrete is produced by molding a wet concrete mixture.

Unlike conventional concrete blocks and precast concrete, cast stone has been made by a so-called "dry tamp" process in which the mixture of portland cement and aggregates is introduced into a mold along with only enough water to achieve an "earth moist" condition. While in the mold, the mixture is subjected to vibratory tamping by means of a hand-held tamping instrument. The dry tamp process is labor-intensive and time consuming.

Cast stone has also been made by a process in which a wet mixture is placed in a mold, which is then physically dropped or vibrated so that the inertia of the wet mixture in the mold eliminates voids. The wet mixture can take up to a full day to harden before it can be released from the mold without slumping. This process, therefore, is very time consuming.

The principal object of this invention is to provide an improved molding process for producing cast stone, by which a high quality product can be produced more quickly and less expensively.

Another object of the invention is to provide a simple, efficient and easily used apparatus for carrying out the molding process.

In accordance with the invention, cast stone is made from a concrete mixture comprising an aggregate and Portland cement by a jolt-squeeze process resembling the process in which sand is packed in a mold box in a foundry operation. The jolt squeeze apparatus used in accordance with the invention resembles the jolt squeeze mechanisms described in U.S. Pat. Nos. 3,385,347 dated May 28, 1968, 3,443,626, dated May 13, 1969 and 3,658,118, dated Apr. 25, 1972.

In the jolt-squeeze process of the invention, the aggregate-Portland cement mixture is repeatedly jolted by dropping the mold, and pressure is then applied to the surface of the mixture. More specifically, the process comprises the following steps. The concrete mixture is introduced into a mold box having a bottom wall and side walls extending upward from the bottom wall, the bottom wall and side walls serving to contain said concrete mixture against gravity-induced flow outward from the mold box. The mold box is then repeatedly subjected to alternate upward and downward movements, each downward movement being stopped by subjecting the mold box to an upwardly directed acceleration the magnitude of which substantially exceeds the maximum magnitude of acceleration of the mold box during other portions of its upward and downward movements. The upwardly directed acceleration can be achieved by causing the mold box to engage an anvil at the end of each downward movement. Downward pressure is thereafter applied to the top surface of the concrete mixture in the mold box, so that the concrete mixture is formed into a solid molded body conforming in shape to the interior of the mold box. Finally the solid molded body is removed from the mold box.

To achieve optimum results in terms of product density and quality, a jolt-squeeze-vibrate process is used. In this process, the repeated lifting and dropping and squeezing operations are carried out as described above. In addition, during the application of downward pressure, the mold box is subjected to a series of rapidly repeated upward mechanical blows.

Further objects, details and advantages of the invention will be apparent from the following detailed description, when read in conjunction with the drawings.

DETAILED DESCRIPTION

Figure 1:
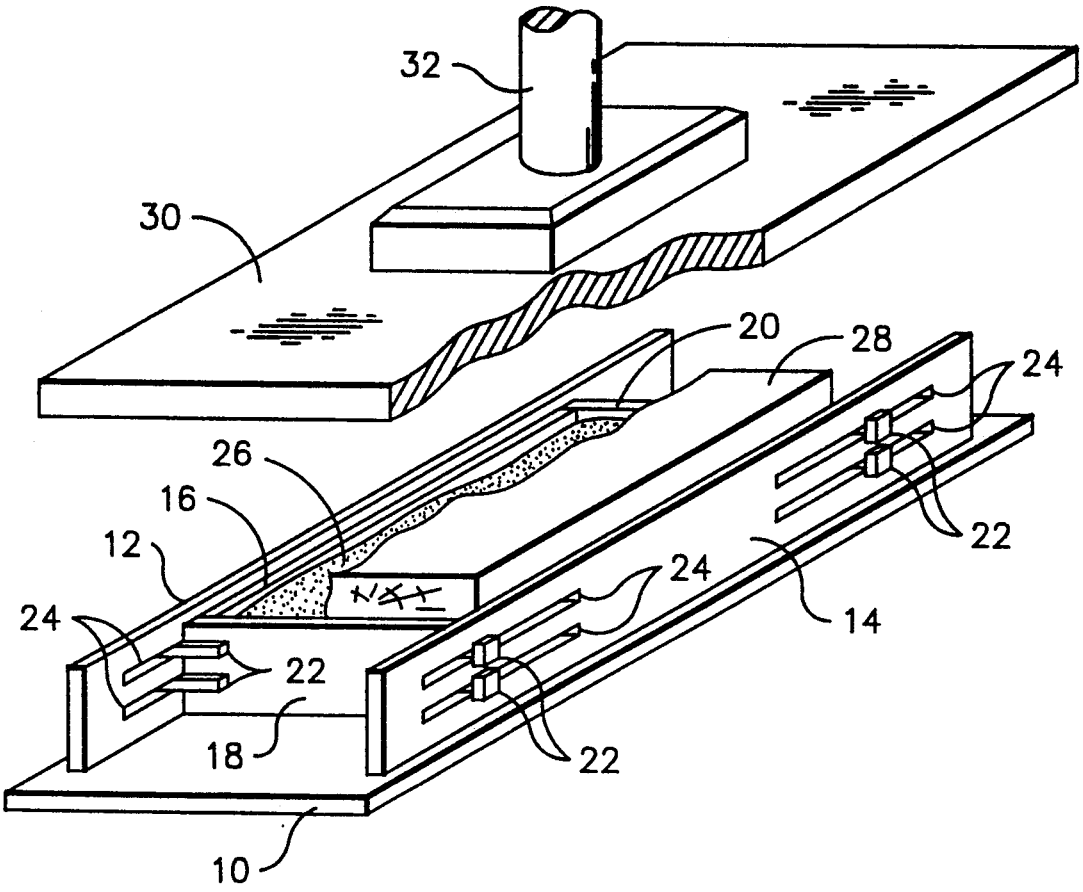
FIG. 1 is an exploded, partially broken-away, perspective view showing a typical mold box and support in accordance with the invention, with a press board and platen used to apply downward pressure to the contents of the mold box.

FIG. 1 shows a mold box support comprising a metal bottom plate 10 having parallel side walls 12 and 14. Between the side walls, there is held a U-shaped wooden mold box 16 having its ends closed by metal end plates 18 and 20. These end plates are held in place by clamps 22 schematically shown in slots 24.

The mold box contains a mixture 26 of portland cement and aggregate, together with a small quantity of water, sufficient to give the mixture an "earth moist" consistency. The mixture preferably utilizes approximately three parts of fine concrete aggregates to one part of Portland cement. The ratio can be varied up to 6:1. A wooden press board 28 is shown on top of the mixture in the mold box. The horizontal length and width of the press board are chosen so that it closely fits the mold box. The vertical thickness of the press board is chosen so that, when it is initially placed in the mold box, it extends upward beyond the upper edges of side walls 12 and 14 by a distance equal to the desired compression stroke. Platen 30, which acts against the top surface of the press board, is supported in a fixed position by a stem 32, which is in turn supported on a head affixed to the frame of a jolt-squeeze-vibrate mechanism (not shown in FIG. 1). The jolt-squeeze-vibrate mechanism presses the mold box support upward. When this occurs, platen 30 pushes the press board into the mold box until the bottom surface of the platen contacts the upper edges of side walls 12 and 14. Thus, the extent to which the contents of the mold box are compressed is controlled by the vertical thickness of the press board.

Figure 2:
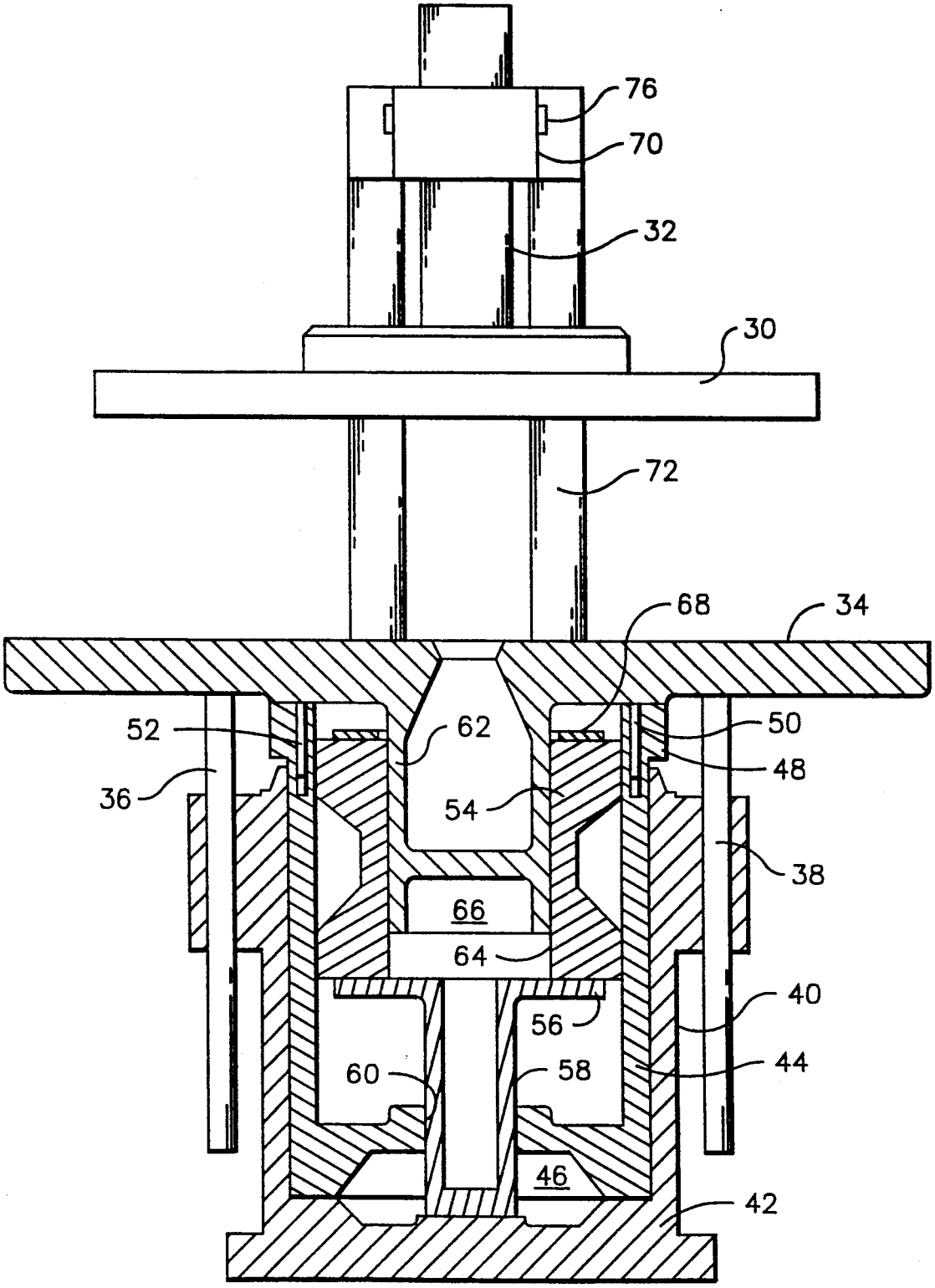
FIG. 2 is a schematic elevational view, partly in section, of a mechanism for carrying out the jolt-squeeze-vibrate operations on the mold box.

The jolt-squeeze-vibrate mechanism is shown in FIG. 2. The mechanism comprises a table 34, on which the mold box support 10 (not shown in FIG. 2) is held during the jolt, squeeze and vibrate operations. Table 34 has affixed to it two downwardly projecting guide pins 36 and 38, which are slidable in passages provided on the outside of an outer cylinder 40 on base 42.

A large diameter squeeze piston 44, typically twenty four inches in diameter, is vertically slidable in outer cylinder 40, and moves upward under the force of compressed air delivered to chamber 46 underneath piston 44 through an air passage (not shown). The stroke of the squeeze piston is typically eight inches.

Table 34 is shown resting on a rim 48 at the top of piston 44. The table is vertically separable from the piston. Guide pins 50 and 52, fixed to the table, extend into holes formed in rim 48 to insure that the table and piston 44 remain in alignment.

Squeeze piston 44 is hollow and contains a jolt and vibrate cylinder 54, which is vertically slidable within piston 44. The flange 56 of a large guide pin 58 is fixed to the bottom of cylinder 54. The guide pin is slidable in a bore 60 in the bottom of squeeze piston 44, and a seal (not shown) is provided between pin 58 and bore 60. It will be apparent, therefore, that air pressure applied to chamber 46 underneath piston 44 raises piston 44 relative to cylinder 40, and also raises cylinder 54 within piston 44. Because the diameter of pin 58 is much less than the diameter of squeeze piston 44, it is possible for cylinder 54 to be pushed downward while the squeeze piston is raised.

A piston 62, formed as an integral part of table 34, extends downward into bore 64 of cylinder 54. This bore is typically eleven inches in diameter. Sealing rings (not shown) are provided between piston 62 and bore 64. Compressed air, introduced into chamber 66 below piston 64 through a passage (not shown) causes the table to move upward relative to cylinder 54. A wear ring 68 is provided on the top surface of cylinder 54 for engagement with the underside of table 34.

As shown in FIG. 2, platen 30 is supported horizontally above table 34 by platen support stem 32. Stem 32 is affixed to a head 70 on a frame 72, which is fixed to base 42. The vertical position at which platen 30 is held can be adjusted by moving stem 32 in head 70 and locking the stem to the head by pin 76. Pin 76 can extend through any one of a series of vertically spaced, horizontally extending holes (not shown) in stem 32.

A preferred jolt-squeeze-vibrate mechanism is the so-called "PVKL molding machine", used for foundry molding, and available from International Molding Machine Co. of 1201 North Barnsdale Road, LaGrange Park, Ill. 60525.

Figure 3:
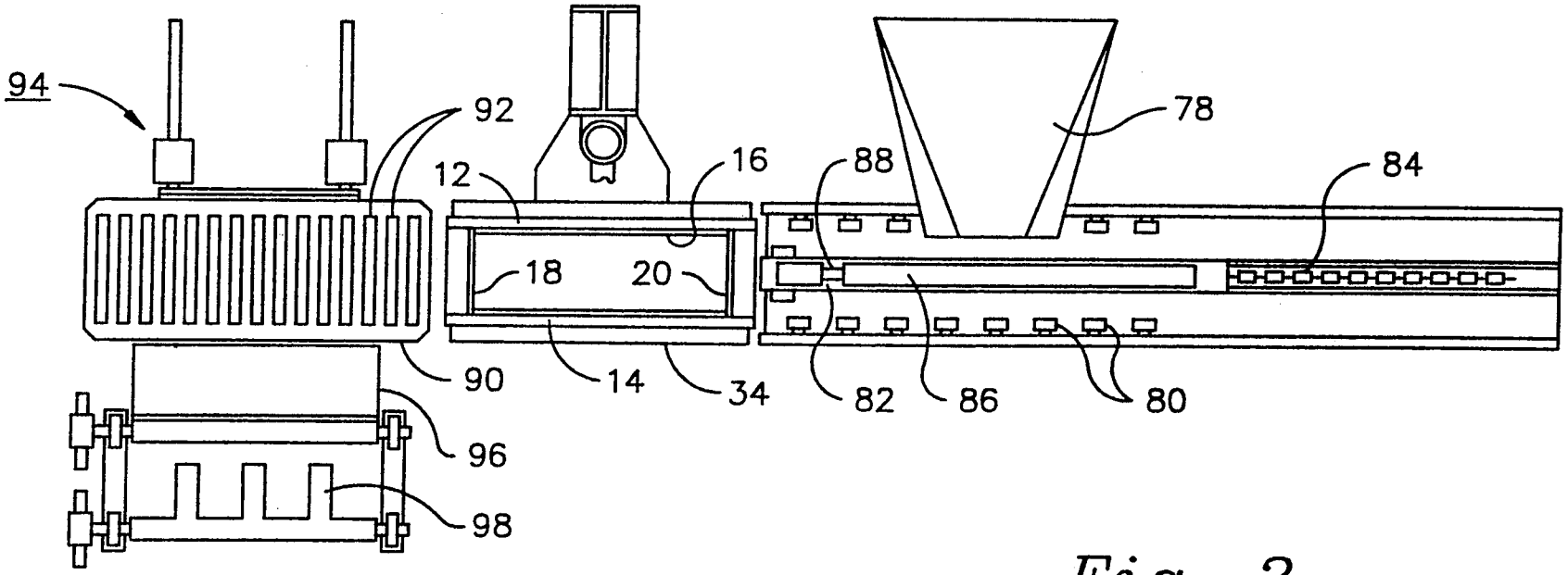
FIG. 3 is a schematic top plan view, partly in section, showing the jolt-squeeze-vibrate mechanism together with a mold box filling and conveying mechanism.

FIG. 3 shows the several stages in the molding operation. In the first stage, the mold box, including the wooden mold, is positioned underneath a chute 78, which is part of a weighing mechanism for dispensing a measured amount of the concrete mixture into the mold. The mold box rests on rollers 80. When filled, it is pushed into position above table 34 by a reciprocating shuttle 82 driven by chain 84. When in position, the mold box is lowered onto the table by a draw mechanism, which has been omitted from the illustration for simplicity. The shuttle carries a fluid-driven actuator 86 having a piston 88 for pushing the wooden mold and the finished cast stone out of the mold box onto a conveyor 90 comprising rollers 92. A pushing mechanism 94 pushes the casting and mold laterally off the conveyor onto a turn-over platform 96, which deposits the casting and mold, upside-down, on a delivery platform 98. The wooden mold can then be removed and returned to the mixture dispensing station for reuse.

In the operation of the apparatus described above, the mold box, with a U-shaped wooden mold closed at its ends by metal end plates 18 and 20, is positioned underneath chute 78. A measured amount of a mixture of Portland cement and aggregate is dispensed into the mold, and the mold is then transported by the shuttle to a location above table 34, and lowered onto the table. The shuttle is then withdrawn.

At this time, squeeze piston 44 remains in its lowermost position, as shown in FIG. 2. Jolting is initiated by introducing compressed air into chamber 66, causing piston 62 to rise in bore 64 of cylinder 54. Table 34 separates from rim 48 of squeeze piston 44. Air is then suddenly released from chamber 66, allowing table 34 to fall against the rim of the squeeze piston. The rim acts as an anvil, so that the downward movement of the table stops suddenly, i.e. the table is subjected to a high acceleration, the vector of which is directed upward. By inertia, the contents of the mold tend to continue to move downward, and are therefore compacted. By repeating the upward and downward movement of table 34, voids in the mixture in the mold are eliminated.

The cycle of upward and downward movements of the table is repeated at a rate between approximately 0.5 and 5 times per second, preferably at a rate of approximately 1.5 times per second. The stroke of the upward and downward movement of the table is preferably approximately 3 inches, but can be longer, or as short as approximately 0.5 inch. The cycle is repeated over a jolting interval between approximately 3 and 30 seconds, preferably approximately 12 seconds.

Following the jolting interval, a squeezing operation takes place. Press board 28 (FIG. 1) is inserted into the mold on the surface of the concrete mixture 26. The press board extends above the top edges of mold box support side walls 12 and 14 by a distance equal to the extent to which the mold contents are to be squeezed. Compressed air is introduced into chamber 46. The compressed air first acts against guide pin 58, causing the guide pin to push up against cylinder 54 until wear ring 68 engages the underside of table 34. The continued introduction of compressed air into chamber 46 causes piston 44 to rise in cylinder 40 so that press board 28 engages the underside of platen 30. The press board is then pushed into the mold until platen 30 is engaged by the upper edges of mold box side walls 12 and 14.

By choosing the appropriate thickness for the press board in relation to the depth of the mixture in the mold box, the pressure applied to the mixture can be controlled. The pressure is in the range of approximately 20 to 500 p.s.i., and preferably in the range of approximately 90 to 120 p.s.i.

Pressure is typically applied to the mixture over an interval from 5 to 60 seconds, during which upward blows are applied to the underside of table 34 repeatedly at a rate from 1 to 85 blows per second. Preferably the blows are applied over an interval of approximately 20 seconds at a rate of approximately 1.5 blows per second. The upward blows are achieved by applying air pressure to, and suddenly releasing air from, chamber 66 below piston 62. With table 34 in the raised condition, and with cylinder 54 pressed upward so that wear ring 68 engages the underside of the table, air pressure in chamber 66 urges guide pin 58 downward so that the wear ring separates from the table. When the air pressure in chamber 66 is suddenly released, the air pressure in chamber 46 pushes upward on pin 58, causing cylinder 54 to move upward so that wear ring 68 sharply engages the underside of table 34. By repeating the application and release of air to and from chamber 66, cylinder 54 applies repeated mechanical blows to the underside of table 34. These mechanical blows move the particles in the mixture so that they are able to be compacted by the pressure applied by platen 30 through press board 28.

Following the application of pressure and repeated mechanical blows, end plates 18 and 20 are removed from the mold, and piston 88 of actuator 86 is extended to push the wooden mold and the casting onto roller conveyor 90. The mold and casting are then pushed laterally onto platform 96 by pushing mechanism 94. Platform 96 then rotates about a horizontal axis to deposit the casting and mold upside-down onto delivery platform 98, where the wooden mold can be removed and returned to the mixture dispensing station for reuse. During the removal of the casting from the wooden mold, the mold box will have been returned to the dispensing station and another wooden mold installed in it so that the new mold can be filled and moved promptly to the jolt-squeeze mechanism.

The finished product is a dense and durable casting having a compressive strength from 3000 to 10,000 p.s.i. It can be made in any desired shape, and most advantageously, the entire molding operation, from start to finish requires only three to four minutes, in comparison with the approximately twenty or more minutes required to produce stone castings using prior methods.

Various modifications can be made to the apparatus and method described. For example, the downward movement of the jolt-squeeze table can be accelerated by a gas-operated piston. Mold boxes can be recirculated through the jolt-squeeze mechanism by a recirculating conveyor. In this way, as one mold box is being opened for removal of the cast stone, another can be assembled, filled and moved into the jolt-squeeze mechanism to maximize the rate of production.

Numerous other modifications can be made to the invention described herein without departing from the scope of the invention as defined in the following claims.

What is claimed is:

1. A method of making a cast building stone from a concrete mixture comprising an aggregate and Portland cement comprising the steps of:

(a) introducing a measured amount of the concrete mixture into a mold box having a bottom wall and side walls extending upward from the bottom wall, the bottom wall and side walls defining an interior space serving to contain the concrete mixture against gravity-induced flow outward from the mold box so that the measured amount of the concrete mixture int he mold box has a top surface;

(b) repeatedly subjecting the mold box, containing the measured amount of the concrete mixture, to alternate upward and downward movements having varying magnitudes of acceleration, stopping each downward movement by subjecting the mold box to an upwardly directed acceleration the magnitude of which substantially exceeds the maximum magnitude of acceleration of the mold box during all other portions of its upward and downward movements;

(c) discontinuing the alternate upward and downward movements and thereafter applying downward pressure to the top surface of the concrete mixture in the mold box; and (d) while the downward pressure is being applied, simultaneously subjecting the mold box to rapidly repeated upward mechanical blows, whereby substantially all of the measured amount of the concrete mixture in the mold box is formed into a solid molded body conforming in shape to the interior space of the mold box to produce a cast building stone; and (e) removing the solid molded body, as the cast building stone, from the mold box.

2. The method according to claim 1 in which the stopping of each of the downward movements of the mold box is effected by engagement of an element fixed to the mold box with an anvil, whereby the mold box is subjected to a sudden, upwardly directed acceleration at the end of each downward movement.

3. The method according to claim 1 in which the upward and downward movements are repeated at a rate between approximately 0.5 and 5 times per second.

4. The method according to claim 1 in which the upward and downward movements are repeated at a rate of approximately 1.5 times per second.

5. The method according to claim 1 in which the upward and downward movements are repeated over a time interval between approximately 3 and 30 seconds.

6. The method according to claim 1 in which the upward and downward movements are repeated over a time interval of approximately 12 seconds.

7. The method according to claim 1 in which the upward and downward movements are repeated at a rate between approximately 0.5 and 5 times per second over a time interval between approximately 3 and 30 seconds.

8. The method according to claim 1 in which the upward and downward movements are repeated at a rate of approximately 1.5 times per second over a time interval of approximately 12 seconds.

9. The method according to claim 1 in which the downward pressure is in a range of approximately 20 to 500 pounds per square inch.

10. The method according to claim 1 in which the upward and downward movements are repeated at a rate between approximately 0.5 and 5 times per second over a time interval between approximately 3 and 30 seconds, and in which the downward pressure is in a range of approximately 20 to 500 pounds per square inch.

11. The method according to claim 1 in which the rapidly repeated upward mechanical blows are applied at a rate between approximately 1 and 85 blows per second.

12. The method according to claim 1 in which the rapidly repeated upward mechanical blows are applied at a rate between approximately 1 and 85 blows per second over a time interval in a range of approximately 5 to 60 seconds and discontinued at the end of the time interval.

13. The method according to claim 1 in which the rapidly repeated upward mechanical blows are applied at a rate of approximately 1.5 blows per second.

14. The method according to claim 1 in which the rapidly repeated upward mechanical blows are applied at a rate of approximately 1.5 blows per second over a time interval of approximately 20 seconds and discontinued at the end of the time interval.

15. The method according to claim 1 in which the upward and downward movements are repeated at a rate between approximately 0.5 and 5 times per second over a time interval between approximately 3 and 30 seconds; in which the downward pressure is in a range of approximately 10 to 500 pounds per square inch; and in which the rapidly repeated upward mechanical blows are applied at a rate between approximately 1 and 85 blows per second over a time interval in a range of approximately 5 to 60 seconds and discontinued at the end of the time interval.

16. The method according to claim 1 in which the upward and downward movements of the mold box have a stroke of approximately 3 inches.

17. The method according to claim 1 in which the mold box is situated on a table and has a top opening, and in which the step of applying downward pressure to the top surface of the concrete mixture in the mold box is carried out by:

(a) placing a press board having upper and lower surfaces into the mold box and onto the top surface of the concrete mixture in the mold box so that the lower surface of the press board engages the top surface of the concrete mixture, the press board being of a height such that it extends upwardly through the top opening of the mold box at least when it is first placed into the mold box:

(b) bringing the top surface of the press board into engagement with a platen;

(c) providing rigid means between the table and the platen for limiting approach of the table toward the platen; and (d) causing relative movement of the table and platen toward each other, thereby applying a downwardly directed force to the press board by the platen whereby the press board is pushed into the mold box until the rigid means causes the relative movement of the table and platen toward each other to stop, and whereby the downward pressure applied to the mixture in the mold box is controlled.

* * * * *